United States Patent [19]

Gentry

[11] Patent Number: 5,005,637

[45] Date of Patent: Apr. 9, 1991

[54] HEAT EXCHANGER U-BEND TUBE SUPPORT

[75] Inventor: Cecil C. Gentry, Bartlesville, Okla.

[73] Assignee: Phillips Petroleum Company, Bartlesville, Okla.

[21] Appl. No.: 927,345

[22] Filed: Nov. 5, 1986

[51] Int. Cl.[5] ..... F28F 9/00

[52] U.S. Cl. ..... 165/69; 165/162; 122/510

[58] Field of Search ..... 165/162, 69, 81, 82; 122/510

[56] References Cited

U.S. PATENT DOCUMENTS

| | | | |
|---|---|---|---|
| 2,853,278 | 9/1958 | Hesler | 257/239 |
| 3,212,567 | 10/1965 | Romanos | 165/69 |
| 3,545,537 | 12/1970 | Hill, Jr. | 165/172 X |
| 3,854,529 | 12/1974 | Sagan | 165/162 |
| 3,929,189 | 12/1975 | Lecon | 165/69 |
| 3,937,277 | 2/1976 | Krolman et al. | 165/162 |
| 3,964,146 | 6/1976 | Vestre et al. | 165/162 X |
| 4,213,499 | 7/1980 | Straffi | 122/510 X |
| 4,429,739 | 2/1984 | Gentry et al. | 165/159 |
| 4,595,161 | 6/1986 | William | 165/162 X |

FOREIGN PATENT DOCUMENTS

| | | | |
|---|---|---|---|
| 86394 | 5/1985 | Japan | 165/82 |
| 956129 | 4/1956 | United Kingdom . | |
| 1261018 | 1/1972 | United Kingdom . | |

OTHER PUBLICATIONS

Paper Entitled "System 80 NSSS Steam Generator Design" by H. K. Williams, Section Manager, Steam Generators, Nuclear Power Systems, Combustion Engineering, Inc., of Chattanooga, Tennessee.

*Primary Examiner*—Stephen F. Husar
*Assistant Examiner*—Peggy A. Neils
*Attorney, Agent, or Firm*—Laney, Dougherty, Hessin & Beavers

[57] ABSTRACT

A support apparatus for tubes in a U-bend portion of a tube bundle. The support apparatus includes a U-tube ring positioned around the tubes in the U-bend portion and having first and second tube separation elements extending therefrom through first and second lanes between the tubes, respectively. The first tube separation elements are preferably characterized by flat plates or strips defining a plurality of holes therethrough, and the second tube separation elements are preferably characterized by rods or bars extending through aligned sets of holes in the plates or strips. A support bar extends between opposite end portions of the ring, and the plate have notches therein for engaging corresponding notches in the support bar and ring. The ring and support bar are slidably attachable to a mounting bracket on a tube support used to support a first and second pass of longitudinal tubes in the tube bundle. A method is disclosed for fabricating the U-bend tube support.

23 Claims, 5 Drawing Sheets

HEAT EXCHANGER U-BEND TUBE SUPPORT

BACKGROUND OF THE INVENTION

1. Field of the Invention

This invention relates to supporting apparatus for tube bundles in heat exchangers, and more particularly, to a support for the U-bend tube portion of such tube bundles.

2. Description of the Prior Art

In large heat exchangers, unsupported heat exchanger tubes may be subject to vibrations induced by fluid flowing over the tubes on the outside thereof. This can result in undesired vibration and noise in the heat exchanger. Also, vibration can cause collision and resulting damage to the tubes. To solve this problem, various tube supports have been designed for supporting the tubes to prevent such vibration. The problem with such supports is that they must be carefully designed to avoid obstruction of fluid flow which can result in reduced heat transfer. Several devices have been developed which adequately support the longitudinal tubes in the heat exchanger, but support for the U-bend tube portion is more difficult. Thus, while support of the longitudinal portions is important, vibration can still occur as a result of fluid flow over unsupported U-bend portions.

In U.S. Pat. No. 4,429,739 to Gentry et al., assigned to the assignee of the present invention, one or more V-shaped spacers are placed between adjacent tube panels. While this helps prevent some vibration, it is not totally adequate because the tubes are not supported on all sides. In this apparatus, vertical and horizontal support strips are positioned between the longitudinally extending straight tubes. Rods are positioned in grooves in the strips for additional support of the tubes. Such a support system is essentially the same as disclosed herein for the first and second passes of the longitudinally extending tubes.

In a steam generator design of Combustion Engineering, Inc., vertical and horizontal strips are shown to provide support for the U-bend region of heat exchanger tubes, and is easily adapted to the apparatus shown in U.S. Pat. No. 4,429,739 to Gentry et al. However, such a system does not provide the complete and rigid support of every tube as in the present invention.

U.S. Pat. No. 3,545,537 to Hill, Jr., discloses vertical plates between layers of tubes. Horizontal members fit in slots in the vertical plates and have staggered, curved recesses for supporting horizontal portions of the U-bend tubing. The apparatus is adapted to allow for expansion of the tubing. One problem with such a system is the large area of contact of the support with the tubes which can result in a reduction in heat transfer. The support of the present invention contacts the tubes at a single point or at most a single longitudinal line therealong.

SUMMARY OF THE INVENTION

The U-bend tube support of the present invention is adapted for use with a tube bundle having a first pass and a second pass of tubes, a supporting means for supporting the first and second passes, and a U-bend tube portion adjacent the supporting means for interconnecting the first and second passes of tubes. The U-bend tube support of the present invention comprises frame means attached to the supporting means and disposed adjacent longitudinally outer ends of tubes in the U-bend tube portion and divider means extending from the frame means between the tubes in the U-bend tube portion for dividing and supporting the tubes.

The frame means includes a ring at least partially encompassing outer ends of the tubes in the U-bend tube portion. The ring has a first end portion attached to the supporting means at a point transversely between the first pass and second pass and a second end portion opposite the first end portion and attached to the supporting means at a point transversely between the second pass and the first pass. The ring is preferably positioned in a plane dividing the first and second passes.

Preferably, the divider means comprises first divider means extending from the frame means in a first direction between the tubes in the U-bend tube portion and a second divider means extending from the frame means in a second direction between the tubes. The first divider means is preferably characterized by a plurality of substantially parallel plates or strips, each plate or strip defining a plurality of holes therethrough. The second divider means is preferably characterized by a plurality of substantially parallel rods or bars disposed through the holes in the plates or strips.

A strip support bar extends between the first and second passes on an opposite side of the U-bend tube portion from the ring of the frame means and defines a plurality of notches therein. The ring also defines a plurality of notches aligned with the notches in the support bar, and each of the plates or strips defines a first notch adjacent an end thereof and a second notch adjacent an opposite end thereof. The first notch is engageable with a notch on the support bar and the second notch is engageable with an aligned notch on the frame means.

Means are also provided for slidably attaching the frame means to the supporting means for allowing movement of the frame means, the first and second divider means and the U-tubes, and thereby compensating for expansion and contraction of the U-bend tube portion of the tube bundle.

One method of fabricating a supported tube bundle having a plurality of tubes comprises the steps of positioning a strip support bar transversely adjacent an end of a tube support, attaching first ends of a plurality of spaced first tube separation elements to the strip support bar, alternately positioning U-bend tube portions of the tubes and second tube separation elements between the first tube separation elements such that a plurality of alternating tube rows and second tube separation elements are formed in a plane of the first tube separation elements and first and second passes of the U-tubes extend substantially parallel into the tube support, and attaching a U-tube ring around the U-bend tube portions in said plane. The method also comprises the step of slidably attaching the U-tube ring to the tube support.

For the embodiment in which the first tube separation elements are characterized by flat plates or strips with a plurality of spaced holes therethrough and the second tube separation elements are characterized by rods or bars, the step of positioning the second tube separation elements comprises inserting the rods or bars through aligned sets of holes in the plates or strips.

An important object of the present invention is to provide a support apparatus for U-tubes in a tube bundle for preventing vibration of the U-tubes due to fluid flow thereacross.

Another object of the invention is to provide a supporting apparatus tubes in a U-bend tube portion of a tube bundle which includes a frame means disposed around the U-bend tube portion with divider means extending between the tubes.

Still another object of the invention is to provide a U-bend tube support having a ring extending over a plurality of U-bend tubes with a first multiplicity of tube separation elements attached to the ring and extending in the plane thereof in at least a portion of a first plurality of lanes between the tubes, and a second multiplicity of tube separation elements extending in the plane of the ring in at least a portion of a second plurality of lanes between the tubes and attached to at least a portion of the first multiplicity of tube separation elements.

A further object of the invention is to provide a method of fabricating a U-tube support apparatus such that at least some of the tubes in the U-bend tube portion are supported on four sides.

Additional objects and advantages of the invention will become apparent as the following detailed description of the preferred embodiments is read in conjunction with the drawings which illustrate such preferred embodiments.

DESCRIPTION OF THE PREFERRED EMBODIMENTS

Figure 1:
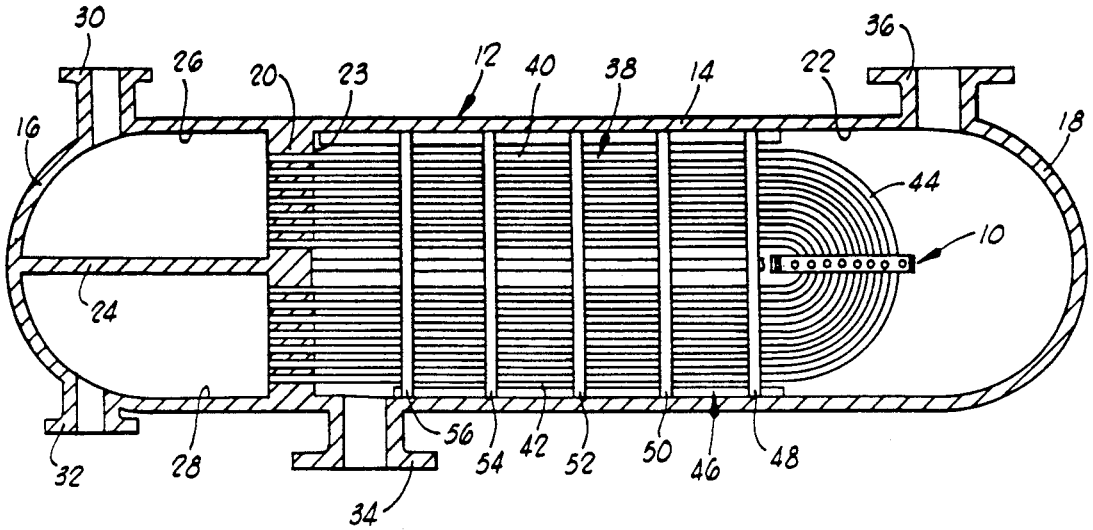
FIG. 1 is a longitudinal cross section of a heat exchanger with a first embodiment of the U-bend tube support of the present invention.

Referring now to the drawings, and more particularly to FIG. 1, a first embodiment of the U-bend tube support of the present invention is shown and generally designated by the numeral 10 in an operating position in a heat exchanger 12.

Heat exchanger 12 includes an elongated, substantially cylindrical housing or shell 14 with a first hemispherical end 16 and a second hemispherical end 18. A tube sheet or plate 20 is disposed transversely in housing 14 such that a tube chamber or cavity 22 is defined therein with a face 23 of tube sheet 20 forming one end of the tube chamber. A longitudinal baffle 24 extends between first end 16 and tube sheet 20 such that an inlet chamber or cavity 26 and an outlet chamber or cavity 28 are formed on an opposite side of tube sheet 20 from tube chamber 22. A tube inlet 30 provides communication with inlet chamber 26 and a tube outlet 32 is provided in communication with outlet chamber 28. A shell inlet 34 and a shell outlet 36 are in communication with tube chamber 22.

Extending from face 23 of tube sheet 20 into tube chamber 22 is a tube bundle, generally designated by the numeral 38. Tube bundle 38 includes a plurality of tubes with a first pass of substantially longitudinal tubes or tube portions 40 in communication with inlet chamber 26 and a second pass of substantially longitudinal tubes or tube portions 42 in communication with outlet chamber 28. First pass 40 and second pass 42 are parallel to a longitudinal axis of tube bundle 38. A plurality of U-bend tubes or tube portions 44 interconnect corresponding tubes or tube portions in the first and second passes 40 and 42. Each tube formed by first pass 40, second pass 42 and U-bend tube 44 may be integrally formed or fabricated from separate elements. Either U-tube construction is known in the art.

A tube support 46, such as disclosed in U.S. Pat. No. 4,429,739 to Gentry et al., provides a supporting means in tube chamber 22 for first and second passes 40 and 42. As will be more fully discussed herein, U-bend tube support 10 is attached to tube support 46 to provide full support for U-bend tubes 44.

Figure 2:
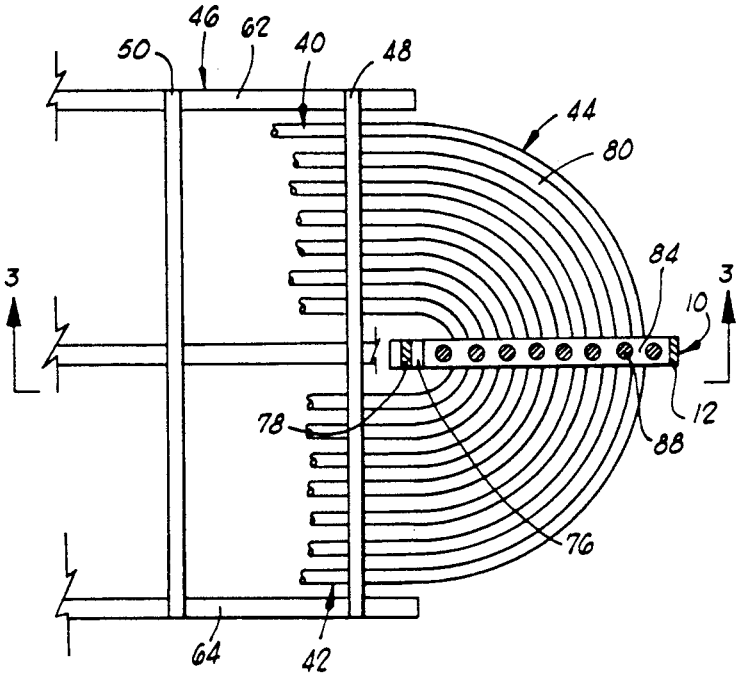
FIG. 2 is an enlarged view of the U-bend area shown in FIG. 1.
Figure 3:
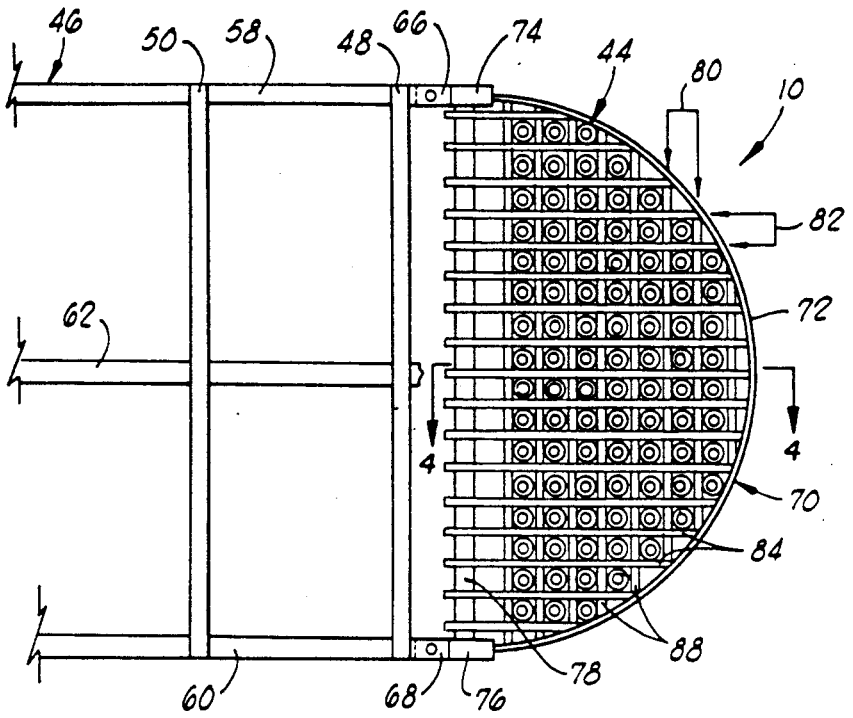
FIG. 3 is a cross-sectional view taken along lines 3—3 in FIG. 2 and showing one tube pattern.

Referring now to FIGS. 2 and 3, details of U-bend tube support 10 are shown in conjunction with U-bend tubes 44, also referred to herein as U-tubes. In this embodiment, the longitudinally outer ends of U-tubes 44 nearest second end 18 of housing 14 are positioned to form a generally curvilinear outline, best shown in FIG. 3. In other words, the outermost U-tubes are 44 not of the same longitudinal length. Such an array of U-tubes 44 is basically determined by the pattern of the first and second pass tubes as they extend from tube sheet 20, and it is not intended that the present invention be limited to such a configuration. In fact, additional embodiments are shown herein.

Generally, tube support 46 for first and second passes 40 and 42 includes a plurality of spaced support rings, such as 48, 50, 52, 54 and 56. The number and spacing of such support rings is based on the size of heat exchanger 12 and the type of service in which it is used, as is determined in a manner known in the art. As is also known in the art, longitudinal slide bars, such as 58, 60, 62 and 64, are interconnected with support rings 48, 50, 52, 54, and 56 to form a rigid tube support 46. In the preferred embodiment shown, four such slide bars are utilized, although another number could be used.

It should be noted that slide bars 58 and 60 are aligned in a plane that passes between first pass 40 and second pass 42. Slide bars 62 and 64 are positioned in a plane substantially normal to the plane of slide bars 58 and 60, and thus slide bars 62 and 64 are essentially adjacent the outermost sides of first pass 40 and second pass 42, respectively.

Slide bars 58 and 60 include mounting brackets 66 and 68, respectively, at the longitudinal end of the slide bars nearest U-bend tubes 44.

U-bend tube support 10 includes a frame means 70 formed by a U-tube ring 72 with end portions 74 and 76 attached thereto and a strip support bar 78. End portions 74 and 76 of U-tube ring 72 are adapted to be attached to mounting brackets 66 and 68, respectively, in a manner hereinafter described. As described more fully herein, U-tube ring 72 has a mid-portion between end portions 74 and 76 which is adapted for at least partially encompassing the longitudinally outer ends of U-tubes 44 in one plane.

It will be seen that U-bend tubes 44 define a plurality of substantially concentric first open lanes or ligaments 80 therebetween and a plurality of substantially parallel second open lanes or ligaments 82 therebetween in a manner known in the art. Second lanes 82 are substantially perpendicular to first lanes 80 in the cross-sectional view of FIG. 3. In the plane of U-tube ring 72, it will be seen that first lanes 80 are substantially crosswise with respect to the longitudinal axis of tube bundle 38, and second lanes 82 extend substantially lengthwise with respect to the longitudinal axis of the tube bundle.

Figure 4:
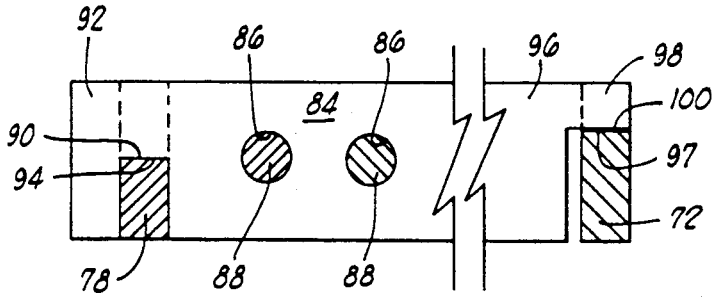
FIG. 4 shows an enlarged cross section taken along lines 4—4 in FIG. 3.

Extending in a first direction from U-bend ring 72 are a multiplicity of substantially parallel first tube separating members or divider means, preferably in the form of flat plates or strips 84. Plates 84 are adapted to fit in corresponding second lanes 82. Preferably, the number of plates 84 equals the number of second lanes 82. Referring also to FIG. 4, each plate 84 defines a plurality of openings or holes 86 therethrough, and these holes are substantially in alignment with first lanes 80.

A multiplicity of second tube separating members or divider means, preferably in the form of rods or bars 88, extend in a second direction from U-tube ring 72. Rods 88 are adapted to fit through aligned holes 86 in flat plate 84 and thus extend through first lanes 80. Preferably, the number of rods 88 equals the number of first lanes 80.

For the arrangement of U-bend tubes 44 shown in FIGS. 2 and 3, it will be seen that plates 84 extend longitudinally with respect to first and second passes 40 and 42, and rods 88 are substantially perpendicular to plates 84. U-tube ring 72, plates 84 and rods 88 generally define a plane which is oriented with respect to the longitudinal axis of tube bundle 38 such that U-tubes 44 pass normally through the plane. Preferably, U-tube ring 72, plates 84 and rods 88 are coplanar with the longitudinal axis of tube bundle 38. U-tubes 44 thus form parallel rows in this plane with first and second lanes 80 and 82 therebetween.

Plates 84 preferably have parallel broad sides positioned normally to the plane defined by U-tube ring 72, plates 84 and rods 88. The length of plates 84 varies as shown in FIG. 3 to conform to the pattern of U-tubes 44. Each plate 84 and rod 88 is sized to be in contact with adjacent U-tubes 44 on both sides thereof. Thus, it will be seen that each U-tube 44 is fully supported on four sides.

Referring again to FIG. 4, one embodiment of a method of attaching plates 84 to frame means 70 is illustrated. Strip support bar 78 has a plurality of spaced notches 90 therein which are substantially aligned with second lanes 82 between U-bend tubes 84. First end 92 of plate 84 defines a notch 94 therein which is aligned and engaged with notch 90 in strip support bar 78. A second end 96 of plate 84 defines a notch 97 such that an outwardly extended portion 98 is formed. Outwardly extended portion 98 is adapted to fit in one of a plurality of notches 100 in U-tube ring 72. Notches 100 are aligned with corresponding notches 90 in strip support bar 78 and second lanes 82 between U-tubes 44. Each plate 84 is fixedly attached to frame means 70 by means such as welding at notches 90 and 100. Rods 88 are also welded to plates 84 and U-tube ring 72 to form a rigid assembly providing full support for all U-tubes 44. The fabrication procedure is described more fully hereinafter.

Figure 5:
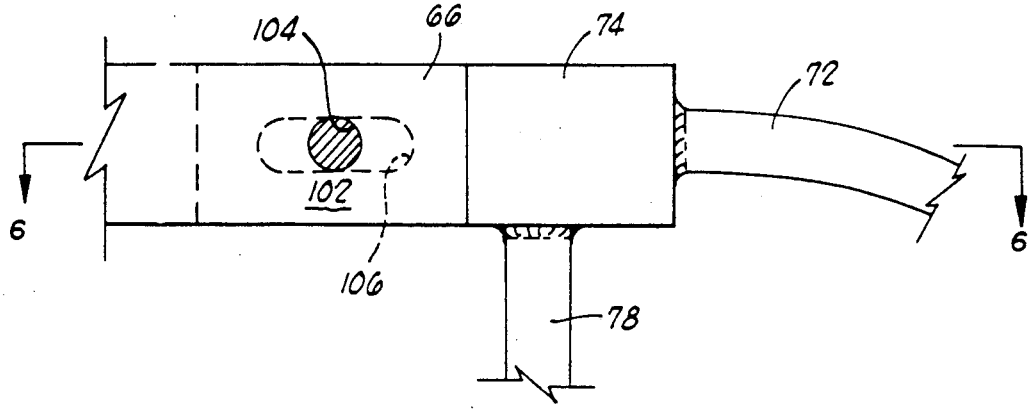
FIG. 5 illustrates an enlarged view of the attachment of the U-bend tube support to a longitudinal tube support.
Figure 6:
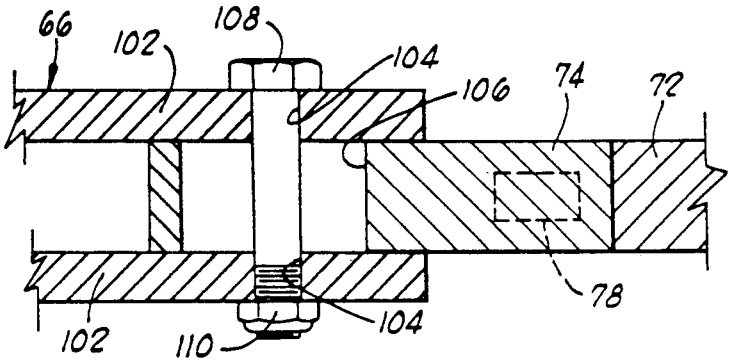
FIG. 6 is a cross section taken along lines 6—6 in FIG. 5.

Referring now to FIGS. 5 and 6, details of mounting bracket 66 and the engagement therewith of end portion 74 of U-tube ring 72 are illustrated. The construction of mounting bracket 68 and the engagement therewith by end portion 76 of U-tube ring 72 is substantially identical. Mounting bracket 66 includes a pair of spaced longitudinally disposed plates 102 having aligned transverse holes 104 therethrough. End portion 74 of U-tube ring 72 is slidably disposed between plates 102 and includes a longitudinally disposed slot 106 which is aligned with holes 104. Fastener means, such as bolt 108 and nut 110 are utilized to hold end portion 74 in place between plates 102. Because end portions 74 and 76 are thus slidably disposed in mounting brackets 66 and 68, it will be clear to those skilled in the art that slidable mounting means are provided whereby the entire assembly including U-bend tube support 10 and U-tubes 44 is free to move longitudinally with respect to first pass 40 and second pass 42 to compensate for expansion and contraction of tube bundle 38.

Figure 7:
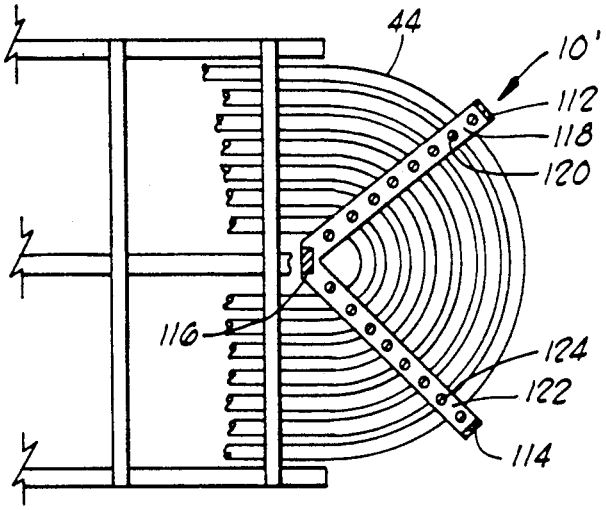
FIG. 7 shows an alternate embodiment of the U-bend tube support with two support rings.

Referring now to FIG. 7, an alternate embodiment of the U-bend tube support, identified by reference numeral 10', is shown in place around U-bend tubes 44. In U-bend tube support 10', two U-tube rings 112 and 114 are used and are angularly disposed from one another. Extending from U-tube ring 112 toward strip support bar 116 are a plurality of plates or strips 118 with rods or bars 120 passing therethrough. Similarly, plates or strips 122 and rods or bars 124 extend from U-tube ring 114. Such a configuration could be used where the heat exchanger diameter is sufficiently large that a single U-tube support could not solve the tube vibration problem.

Figure 8:
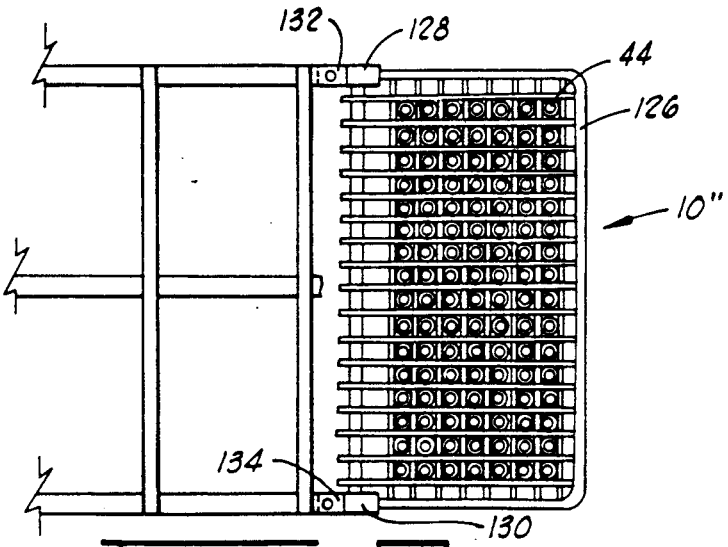
FIG. 8 illustrates an alternate embodiment of the U-bend tube support of the present invention adapted for another tube pattern.

FIG. 8 illustrates an alternate U-bend tube support 10'' with a rectangularly shaped U-tube ring 126 having end portions 128 and 130 attached to mounting brackets 132 and 134, respectively. In this embodiment, U-bend tubes 44 are arranged in a pattern in which the outermost tubes thereof are aligned such that a rectangular pattern is formed. Other than the pattern of U-tubes 44 and the shape of U-tube ring 126, this U-bend tube support 10'' is essentially identical to the embodiment shown in FIGS. 2 and 3.

Figure 9:
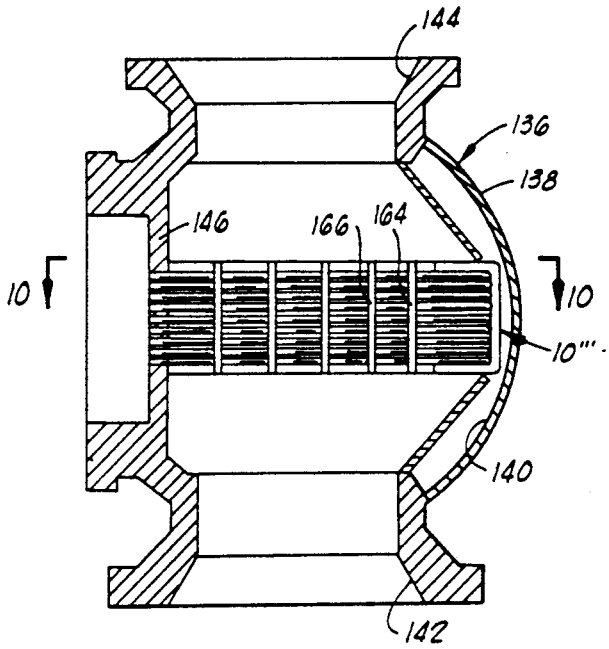
FIG. 9 is a vertical cross section through another heat exchanger design also having a tube bundle with a U-bend portion.
Figure 10:
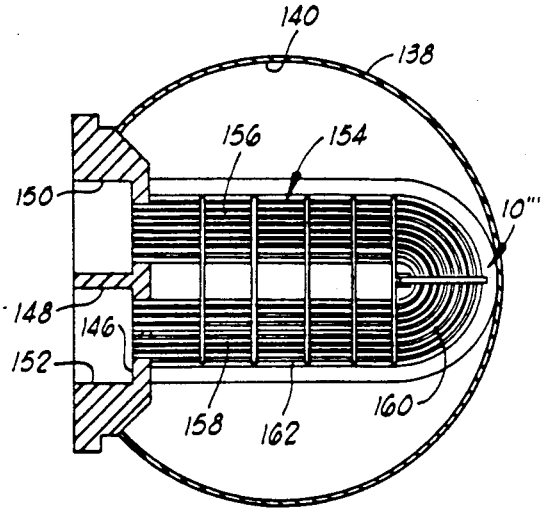
FIG. 10 is a horizontal cross section taken along lines 10—10 in FIG. 9.

Still another embodiment of the U-bend tube support of the present invention is shown in FIGS. 9 and 10, and generally designated by the numeral 10'''. For illustrative purposes only, U-bend tube support 10''' is shown installed in a heat exchanger 136 which is different in configuration from heat exchanger 12 shown in FIG. 1. Heat exchanger 136 includes a substantially spherical housing 138 defining a tube chamber or cavity 140 therein with an inlet 142 and an outlet 144. A tube sheet or plate 146 and a baffle 148 separate a tube inlet chamber 150 from a tube outlet chamber 152, and further separates the tube inlet and outlet chambers from tube chamber 140 in a manner similar to the first embodiment.

Also similar to the first embodiment, a tube bundle 154 extends longitudinally from tube sheet 146. Tube bundle 154 includes a first pass of tubes 156, a second pass of tubes 158 and a plurality of U-bend tubes 160, also referred to as U-tubes, which interconnect corresponding tubes in the first and second passes. A tube support 162, substantially identical to tube support 48 in the first embodiment, provides support for first and second passes 156 and 158.

Figure 11:
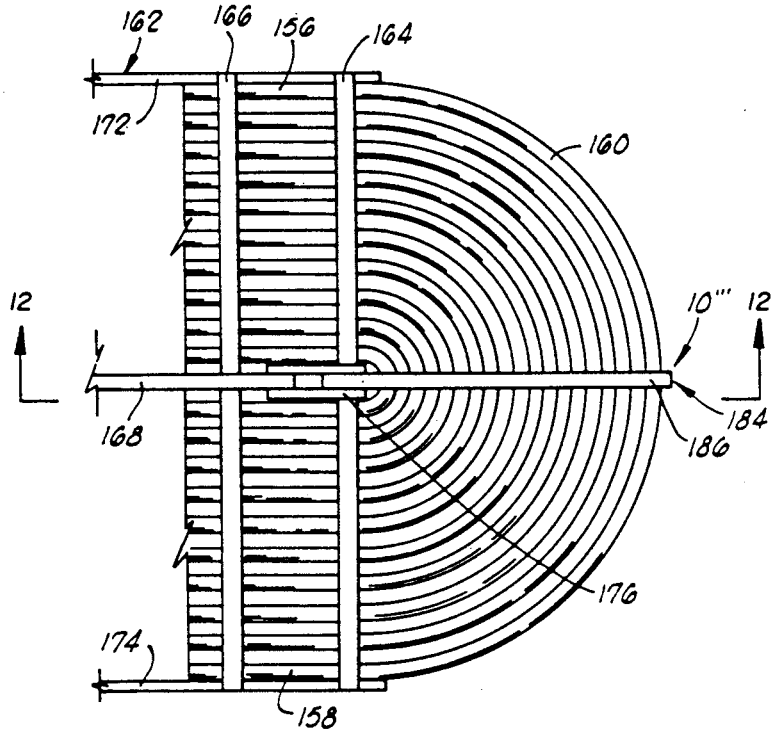
FIG. 11 is an enlarged view of the U-bend tube portion shown in FIG. 10.
Figure 12:
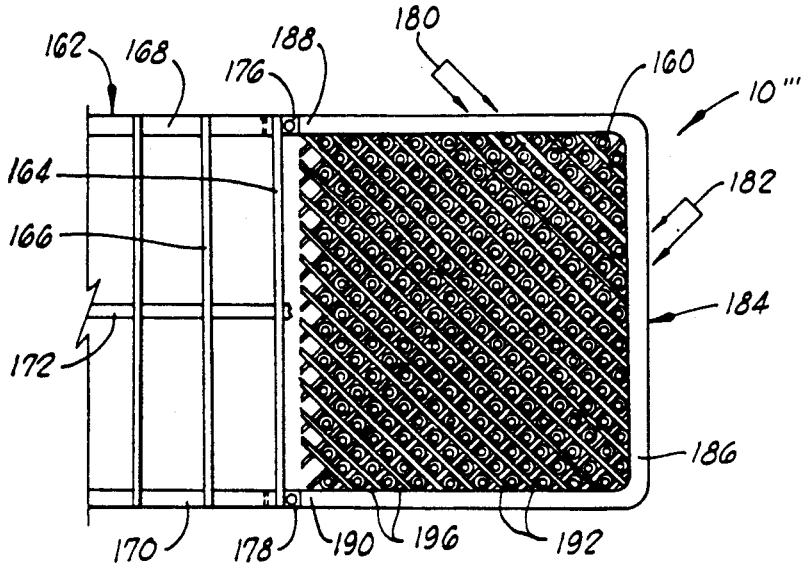
FIG. 12 shows a cross section taken along lines 12—12 in FIG. 11 and showing a rotated square tube pattern.

Referring now to FIGS. 11 and 12, details of U-bend tube support 10''' are shown. As with the previously described embodiment, tube support 162 includes a plurality of support rings, such as 164 and 166, which are spaced along the longitudinal length of first and second passes 156 and 158. Longitudinally disposed slide bars 168, 170, 172 and 174 are attached to the support rings. Mounting brackets 176 and 178 are attached to the longitudinal ends of slide bars 168 and 170, respectively, nearest U-bend tubes 160.

Figure 13:
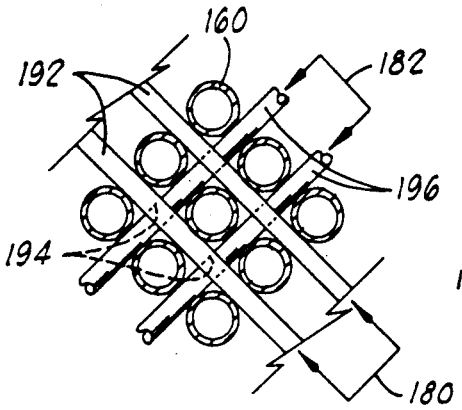
FIG. 13 shows an enlarged portion of the tube pattern shown in FIG. 12.

As seen in FIG. 12 and the enlarged detail of FIG. 13, the rows of U-bend tubes 160 are longitudinally staggered. This pattern is sometimes referred to as a rotated square tube pitch. In the embodiment shown, a plurality of first open lanes is defined in a first diagonal direction between U-bend tubes 160, and a plurality of second open lanes 182 is defined between the tubes in a second diagonal direction which is substantially perpendicular to the direction of first lanes 180.

U-bend tube support 10''' comprises a frame means 184 including a U-tube ring 186 of substantially rectangular shape with a first end portion 188 and a second end portion 190. First end portion 188 is slidably engageable with mounting bracket 176, and second end portion 190 is slidably engageable with mounting bracket 178.

Extending diagonally with respect to U-tube ring 186 and disposed in first lanes 180 between U-tubes 160 are a plurality of first tube separation elements, preferably characterized by flat plates or strips 192. Plates 192 are attached to frame 184 and include a plurality of spaced openings or holes 194 therethrough which are in substantial alignment with second lanes 182 between U-tubes 160. A plurality of second tube separation elements, such as rods or bars 196, are disposed through holes 194 in plates 192 and thus extend through second lanes 182 between U-tubes 160. Although not shown in this embodiment, a strip support bar, similar to strip support bar 78 in the first embodiment, could be disposed transversely between first and second end portions 188 and 190 of U-tube ring 186.

As with the previous embodiments, plates 192 and rods 196 are spaced to be in contact with adjacent U-bend tubes 160. In this way, full support on four sides is provided for the tubes.

Figure 14:
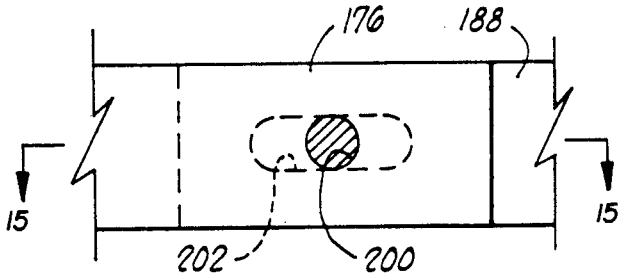
FIG. 14 is an enlarged view of the mounting portion of the U-bend tube support shown in FIG. 12.
Figure 15:
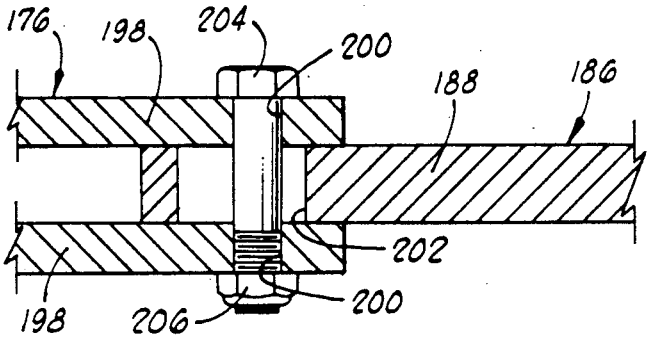
FIG. 15 is a cross section taken along lines 15—15 in FIG. 14.

Referring now to FIGS. 14 and 15, details of mounting bracket 176 are shown. Mounting bracket 178 is substantially identical to mounting bracket 176. Mounting bracket 176 comprises a pair of spaced, longitudinally disposed plates 198 with aligned transverse holes 200 therethrough. First end portion 188 of U-tube ring 186 is slidably disposed between plates 198 and defines a longitudinally disposed slot 202 therethrough which is in substantial alignment with holes 200. Fastener means, such as bolt 204 and nut 206, are used to hold first end portion 188 in place between plates 198 while allowing sliding movement therebetween to compensate for expansion and contraction of U-bend tubes 160 in a manner substantially identical to the first embodiment.

FABRICATION OF THE INVENTION

The preferred method of fabricating the first embodiment of U-bend tube support 10 will now be discussed. Before first and second passes 40 and 42 of the tubes are installed in tube support 46, strip support bar 78 is placed in its transverse position between end portions 74 and 76 prior to the attachment of U-tube ring 72. Plates 84 are positioned and welded at the engagement of slots 90 and 94 on strip support bars 78 in the manner hereinbefore described. After this attachment of plates 84, the rod 88 nearest strip support bar 78 is inserted through the appropriate holes 86 in plates 84. This rod 88 is tackwelded in place. The first or innermost row of U-bend tubes 44 is simultaneously placed in contact with the first rod 88. A second rod 88 is then inserted through the next set of holes 86 in plates 84, and the second row of U-tubes 44 is installed.

After each successive row of U-tubes 44 is installed and each rod 88 is inserted and welded in place, U-tube ring 72 is then positioned around U-tubes 44 and attached to end portions 74 and 76. Plates 84 are then welded to U-tube ring 72 at the engagement of extended portion 98 with notch 100. Rods 88 are also welded to U-tube ring 72.

The other embodiments of the invention are assembled in a similar manner. For U-bend tube support 10''', the embodiment shown in FIGS. 11 and 12, plates 192 and rods 196 are alternately installed as each row of U-bend tubing 160 is put in place. After U-bend tubing 160, plates 192 and rods 196 are so positioned, U-tube ring 186 is put in place and welded to the plates and bars.

It can be seen, therefore, that the U-bend tube support of the present invention is well adapted to carry out the ends and advantages mentioned as well as those inherent therein. While several presently preferred embodiments of the apparatus are shown for the purposes of this disclosure, numerous changes in the arrangement and construction of parts may be made by those skilled in the art. All such changes are encompassed within the scope and spirit of the appended claims.

What is claimed is:

1. A supporting apparatus for use with a tube bundle positionable in a heat exchanger housing and having a first pass and a second pass, a supporting means for supporting said first and second passes, and a U-bend tube portion adjacent the supporting means for interconnecting the passes, said apparatus comprising:

frame means attached to said supporting means and disposed adjacent longitudinally outer ends of tube in said U-bend portion; and divider means extending from said frame means between said tubes in said U-bend portion;

wherein, said frame means and said divider means are unattached to said housing.

2. The apparatus of claim 1 wherein said frame means includes a ring at least partially encompassing said outer ends of said tubes, said ring having:

a first end portion attached to said supporting means at a point transversely between said first pass and said second pass; and a second end portion opposite said first end portion and attached to said supporting means at a point transversely between said second pass and said first pass.

3. The apparatus of claim 1 wherein said frame means is in a plane dividing said first and second passes.

4. The apparatus of claim 1 wherein said divider means comprises:

first divider means extending from said frame means in a first direction between said tubes in said U-bend tube portion; and second divider means extending from said frame means in a second direction between said tubes in said U-bend tube portion.

5. The apparatus of claim 4 wherein: said tubes in said U-bend portion are longitudinally and transversely aligned;

said first direction is a longitudinal direction; and said second direction is a transverse direction.

6. The apparatus of claim 4 wherein:

said tubes are longitudinally and transversely staggered;

said first direction is a diagonal direction with respect to a longitudinal axis of said tube bundle; and said second direction is substantially normal to said first direction.

7. The apparatus of claim 6 wherein said diagonal direction is approximately 45° from said longitudinal axis.

8. The apparatus of claim 4 wherein:

said first divider means is characterized by a plurality of substantially parallel plates, each plate defining a plurality of holes therethrough; and said second divider means is characterized by a plurality of substantially parallel rods disposed through said holes.

9. The apparatus of claim 8 further comprising a support bar extending between said first and second passes on an opposite side of said U-bend tube portion from said frame means, said support bar defining a plurality of notches thereon;

wherein:

said frame means defines a plurality of notches aligned with said notches on said support bar; and each of said plates defines a first notch adjacent an end thereof and a second notch adjacent an opposite end thereof, said first notch being engageable with a notch on said support bar and said second notch being engageable with an aligned notch on said frame means.

10. The apparatus of claim 1 further comprising means for slidably attaching said frame means to said supporting means for allowing movement of said frame means, said divider means, and said tubes in said U-bend tube portion and compensating in a longitudinal direction for expansion and contraction of said U-bend tube portion of said tube bundle.

11. The apparatus of claim 10 wherein said means for slidably attaching comprises:

a mounting bracket having a pair of spaced plates defining aligned holes transversely therethrough;

an end portion of said frame means slidably disposed between said plates and defining a longitudinally oriented slot aligned with said holes in said plates; and fastener means extending through said holes and slot for holding said end portion between said plates.

12. An apparatus for use in a heat exchanger housing comprising:

a tube sheet positionable in said housing having a face;

a first pass of parallel tube portions extending from said face of said tube sheet and longitudinally with respect to said housing;

a second pass of parallel tube portions extending from said face of said tube sheet and longitudinally with respect to said housing, said tube portions in said second pass being generally parallel with said tube portions in said first pass;

a plurality of U-bend tube portions interconnecting each tube portion in said first pass with a tube portion in said second pass, thus forming a U-tube bundle having a longitudinal axis, with each tube portion in said first pass being interconnected with a tube portion in said second pass;

a tube support disposed around said first pass and said second pass adjacent said U-bend tube portions, said support having first and second portions aligned in a plane between said first pass and said second pass;

a ring unattached to said housing and having a mid-portion extending over said plurality of U-bend tube portions, said ring having a first end attached to said first portion of said tube support and a second end attached to said second portion of said tube support; and means for supporting said U-bend tube portions and attached to said ring.

13. The apparatus of claim 12 wherein said ring lies in a plane which is oriented with respect to said longitudinal axis of said tube bundle such that said U-bend tube portions pass normally through said plane.

14. The apparatus of claim 13 wherein:

said U-bend tube portions are arranged in said plane of said ring in a first set of parallel tube rows with a first plurality of lanes between said rows, and a second set of parallel tube rows with a second plurality of lanes between said second set of parallel tube rows; and said means for supporting said U-bend tube portions comprises:

a first multiplicity of tube separation elements attached to said ring and extending in said plane thereof in at least a portion of said first plurality of lanes; and a second multiplicity of tube separation elements extending in said plane of said ring in at least a portion of said second plurality of lanes and attached to at least a portion of said first multiplicity of tube separation elements.

15. The apparatus of claim 14 wherein:

said first plurality of lanes extends generally lengthwise along said tube bundle with respect to said longitudinal axis thereof;

said second plurality of lanes extends generally crosswise through said tube bundle with respect to said longitudinal axis thereof;

said first multiplicity of tube separation elements comprises plates having parallel broad sides positioned normally to said plane of said ring; and said second multiplicity of tube separation elements comprises bars passing through said plates wherein said plates and bars are sized for contacting said tube portions on each side of the lanes in which they are positioned.

16. The apparatus of claim 14 wherein said first multiplicity of tube separation elements is equal in number to said first plurality of lanes.

17. The apparatus of claim 14 wherein said second multiplicity of tube support elements is equal in number to said second plurality of lanes.

18. The apparatus of claim 13 wherein said plane of said ring is co-planar with said longitudinal axis of said tube bundle.

19. The apparatus of claim 12 further comprising:

a series of support rings encircling said tube bundle at spaced apart longitudinal positions;

means for supporting said tube portions in said first pass and said second pass and attached to each support ring in said series; and at least one pair of bars extending in a generally longitudinally direction along an outer periphery of said tube bundle and connecting said series of support rings and said tube support to which said ring is attached;

wherein, said ring is attached to an end portion of said pair of bars.

20. A heat exchanger comprising:

a housing defining a tube chamber therein;

a tube plate at an end of said tube chamber;

a plurality of substantially parallel tubes extending from said tube plate in a longitudinal direction in said tube chamber, said tubes being divided into a first pass and a second pass of tubes;

a plurality of U-bend tubes, each U-bend tube interconnecting a tube in said first pass with a corresponding tube in said second pass, said U-bend tubes defining a plurality of first lanes therebetween and a plurality of second lanes therebetween substantially perpendicular to said first lanes;

a tube support adapted for supporting said first and second passes of said tubes within said housing and having an end adjacent said U-bend tubes;

first and second mounting brackets positioned on said end of said tube support and aligned in a plane passing between said first and second passes of tubes;

a frame disposed around said U-bend tubes and in said plane between said first and second passes, said frame comprising:

a first end engaged with said first mounting bracket and longitudinally slidable therewith; and a second end engaged with said second mounting bracket and longitudinally slidable therewith;

a plurality of first tube dividers attached to said frame and disposed in said first lanes; and a plurality of second tube dividers attached to said frame and disposed in said second lanes.

21. The heat exchanger of claim 20 wherein:

each of said first tube dividers is characterized by a flat plate having a plurality of openings therethrough, each of said openings being aligned with one of said second lanes; and each of said second tube dividers is characterized by a rod extending through aligned sets of said openings in said plates.

22. The heat exchanger of claim 21 wherein each of said plates and rods is in contact with tubes adjacent thereto.

23. The heat exchanger of claim 20 wherein:

each of said first and second mounting brackets comprises a pair of spaced plates with aligned holes therethrough; and said first and second ends of said frame define a slot therethrough alignable with said holes in said spaced plates in said mounting brackets; and further comprising fastener means for passing through said aligned holes and slots for holding said first and second ends of said frame between said plates of said mounting brackets, such that said frame is movable in a longitudinal direction for compensating for expansion and contraction of said U-bend tubes.

* * * * *

UNITED STATES PATENT AND TRADEMARK OFFICE

CERTIFICATE OF CORRECTION

PATENT NO. : 5,005,637

DATED : April 9, 1991

INVENTOR(S) : Cecil C. Gentry

It is certified that error appears in the above-identified patent and that said Letters Patent is hereby corrected as shown below: On the title page:

Item [57], line 13, delete "plate" and insert --plates-- therefor.

Column 8, line 53, delete "tube" and insert --tubes-- therefor.

Signed and Sealed this

Twenty-fourth Day of August, 1993

Bruce Lehman

*Attest:*

BRUCE LEHMAN

*Attesting Officer*

*Commissioner of Patents and Trademarks*